US009863407B2

(12) United States Patent
Yi et al.

(10) Patent No.: US 9,863,407 B2
(45) Date of Patent: Jan. 9, 2018

(54) HYDRAULIC OIL CYLINDER, HYDRAULIC CUSHION SYSTEM, EXCAVATOR AND CONCRETE PUMP TRUCK

(75) Inventors: Xiaogang Yi, Hunan (CN); Yongdong Liu, Hunan (CN); Bingbing Chen, Hunan (CN)

(73) Assignees: HUNAN SANY INTELLIGENT CONTROL EQUIPMENT CO., LTD., Changsha, Hunan (CN); SANY HEAVY INDUSTRY CO., LTD., Changsha, Hunan (CN)

( * ) Notice: Subject to any disclaimer, the term of this patent is extended or adjusted under 35 U.S.C. 154(b) by 1072 days.

(21) Appl. No.: 13/811,594

(22) PCT Filed: Jun. 21, 2011

(86) PCT No.: PCT/CN2011/076029

§ 371 (c)(1),
(2), (4) Date: Jun. 6, 2013

(87) PCT Pub. No.: WO2012/010033

PCT Pub. Date: Jan. 26, 2012

(65) Prior Publication Data

US 2013/0255245 A1 Oct. 3, 2013

(30) Foreign Application Priority Data

Jul. 23, 2010 (CN) ..... 2010 1 0235138

(51) Int. Cl.
*F15B 15/22* (2006.01)
*F04B 1/00* (2006.01)

(52) U.S. Cl.
CPC ..... *F04B 1/00* (2013.01); *F15B 15/222* (2013.01)

(58) Field of Classification Search
CPC ..... F15B 15/222; F15B 15/223; F16F 9/3405; F16F 9/486; F16F 9/48
(Continued)

(56) References Cited

U.S. PATENT DOCUMENTS 2,556,698 A * 6/1951 Loewe ..... F15B 15/223 91/395
3,136,225 A * 6/1964 Rader ..... F15B 15/223 91/395
(Continued)

FOREIGN PATENT DOCUMENTS

CN 1896552 A 1/2007
CN 201836140 U 5/2011
(Continued)

OTHER PUBLICATIONS

DE2041597A1 eSpacenet Machine Translation.*
(Continued)

*Primary Examiner* — F. Daniel Lopez
*Assistant Examiner* — Dustin T. Nguyen
(74) *Attorney, Agent, or Firm* — Saliwanchik, Lloyd & Eisenschenk

(57) ABSTRACT

The present application discloses a hydraulic oil cylinder, of which a piston rod (3) is provided with at least two cushion collars (4, 11) which are axially slidable along the piston rod (3). Axial throttle oil channels (301*a*, 301*b*) are provided between the cushion collars (4, 11) and a piston (6). A first cushion collar (4) is provided with a sealing end face (401), and an end cover of a rod cavity (1) is provided with a sealing end face (101). The sealing end face (401) of the first cushion collar contacts with the sealing end face (101) of the end cover of the rod cavity to form a seal. Hydraulic oil within the rod cavity is discharged through one axial throttle oil channel (301*a*) to an oil passage B.

12 Claims, 11 Drawing Sheets

(58) Field of Classification Search
USPC ..... 91/396, 405, 394, 395, 26; 92/9, 128
See application file for complete search history.

(56) References Cited

U.S. PATENT DOCUMENTS 3,157,095 A * 11/1964 Heiser ..... F15B 15/223 267/119
3,507,190 A * 4/1970 Kluczynski ..... F15B 15/222 91/395
3,805,672 A * 4/1974 Pekrul ..... F15B 15/223 91/26
3,974,910 A * 8/1976 Papai ..... F15B 15/222 198/835
3,999,463 A * 12/1976 Greenwood ..... F15B 15/223 91/26
4,207,807 A * 6/1980 Takata ..... F15B 15/1438 403/30
4,425,836 A * 1/1984 Pickrell ..... F15B 15/224 91/405
7,581,485 B2 * 9/2009 Riedel ..... F15B 15/222 91/395
2003/0140781 A1 * 7/2003 Weiss ..... F15B 15/223 92/85 B

FOREIGN PATENT DOCUMENTS

CN 201836141 U 5/2011
DE 2041597 A1 * 8/1971 ..... F15B 15/222
DE 102005015091 * 10/2006 ..... F15B 15/222
JP 11-132203 A 5/1999
WO WO-01/90585 A1 11/2001

OTHER PUBLICATIONS

DE102005015091 eSpacenet Machine Translation.*
International Search Report in International Application No. PCT/CN2011/076029, filed Jun. 21, 2011.

* cited by examiner

HYDRAULIC OIL CYLINDER, HYDRAULIC CUSHION SYSTEM, EXCAVATOR AND CONCRETE PUMP TRUCK

CROSS-REFERENCE TO RELATED APPLICATIONS

This application is the U.S. national stage application of International Patent Application No. PCT/CN2011/076029, filed Jun. 21, 2011, which claims priority to Chinese Patent Application No. 2010102358.1, filed Jul. 23, 2010, the disclosures of each of which are incorporated herein by reference in their entirety.

FIELD OF THE INVENTION

The present application relates to the field of hydraulic technology, and particularly to a hydraulic cylinder. The present application also provides a hydraulic buffer system, an excavator and a concrete pump truck including the above hydraulic cylinder.

BACKGROUND OF THE INVENTION

The hydraulic cylinder is a component which is widely used in the construction machinery, and during operations, a piston is required to perform reciprocating movement continuously. When a piston rod extends to a limit position, a piston end face gives a great impact to an end cap, which may cause damages to the hydraulic cylinder. Therefore, a buffer device is required to be provided at that position in order to avoid the damages to the hydraulic cylinder caused by the above impact.

There are great differences between the existing buffer devices due to different application situations and different sizes of the hydraulic cylinders. For small cylinders, compression springs can be employed as buffer devices directly. However, for hydraulic cylinders having a large cylinder diameter and a long stroke, if a compression spring is employed as the buffer device, it is difficult to obtain a spring with sufficient elasticity, and the spring will soon be damaged due to repeated compression. Therefore, for the hydraulic cylinder having a large cylinder diameter and a long stroke, a hydraulic buffering mechanism shown in FIG. 1 is used generally.

Referring to FIG. 1, a buffer device including a big buffer ring 06 and a big buffer sleeve 04 is shown, wherein the big buffer ring 06 is mounted in an intermediate annular groove arranged at a buffering position of a piston rod, and a big buffer sleeve 04 is arranged at the buffering position. A buffer inner hole 07 corresponding to the big buffer sleeve 04 is provided at an opening of the end cap 01 of the rod cavity of the cylinder, and has an inner diameter fitted with the outer diameter of the big buffer sleeve 04. When the piston rod extends out, the big buffer sleeve 04 is firstly inserted into the buffer inner hole 07 to block the oil return passage of the rod cavity in the cylinder barrel 02, and at the same time, a throttle oil channel is formed by a clearance between the big buffer sleeve 04 and the buffer inner hole 07. In this way, the piston 05 can continue to perform movement in the extending direction, but its movement is slowed down due to the damping effect of the throttle oil channel. Further, the closer the piston 05 gets to the end position of the extension movement of the piston rod 03, the longer the throttle oil channel between the big buffer sleeve 04 and the buffer inner hole 07 is, the greater the damping of the throttle oil channel is, the slower the movement of the piston 05 becomes, until the piston rod 03 extends out to reach the end position smoothly.

Currently, the above buffering mechanism is widely used in hydraulic cylinders with a large cylinder diameter and a long stroke to provide a better buffering protection for these hydraulic cylinders.

However, there are obvious defects in the above buffering mechanism. Firstly, the above hydraulic cylinder with a large cylinder diameter and long stroke tends to work in the working conditions of heavy load and high frequency, for example, a drive cylinder used to drive a digging arm of an excavator or the like. In this case, it is required for the big buffer sleeve 04 in the above buffering mechanism to be inserted into the buffer inner hole 07 repeatedly at a high speed. However, the fit clearance between the big buffer sleeve 04 and the buffer inner hole 07 is very small actually, and the piston rod 03 is very heavy, so that the piston rod 03 is likely tilted to one side under gravity. Therefore, the hydraulic cylinder used in the above situation is prone to failure since the buffer sleeve 04 fails to be inserted into the buffer inner hole 07, so that the entire hydraulic cylinder can not operate normally.

Another key problem in the above buffering mechanism is that, the outer diameter of the big buffer sleeve 04 must be precisely fitted with the inner diameter of the buffer inner hole 07, and otherwise the buffering effect may not be achieved. As a result, requirements for the manufacturing precision of the buffering mechanism are extremely high and it is difficult for manufacturers with ordinary production level to meet the requirements. Due to the excessive high requirements of the manufacture precision, the hydraulic cylinders with a large cylinder diameter and a long stroke become a bottleneck problem in producing excavators and other construction machinery, which severely restricts the production capacity of the various manufacturers in the downstream procedures of the production.

SUMMARY OF THE INVENTION

The embodiment of the present application provides a hydraulic cylinder having a buffer mechanism capable of achieving a buffering effect reliably in a large load, high frequency operating condition, and thus having a longer service life. In addition, the requirement for the manufacturing precision of the hydraulic cylinder is low, which facilitates production. The hydraulic cylinder is particularly applicable for a large cylinder diameter and a long stroke, is easy to manufacture and process, and has a good smooth buffering effect.

The embodiment of the present application also provides a device associated with the hydraulic cylinder. Such a device may be a piston rod.

The embodiment of the present application also provides a hydraulic buffer system, an excavator and a concrete pump truck including the above hydraulic cylinder.

The hydraulic cylinder according to the embodiment of the present application includes a rod cavity end cap (1), a cylinder barrel (2), a piston rod (3), a piston (6) and a rodless cavity end cap (12), the rod cavity end cap (1) being provided with an oil passage (B), and the rodless cavity end cap (12) being provided with an oil passage (A), wherein, at least one throttle oil channel (301*a*, 301*b*) is further provided, at least one buffer sleeve is provided on the piston rod (3), the buffer sleeve includes a first buffer sleeve (4) located in a rod cavity and/or a second buffer sleeve (11) located in a rodless cavity, the buffer sleeve (4, 11) is axially slidable along the piston rod (3); i.e. there are at least a first buffer sleeve (4) located in the rod cavity and a second buffer sleeve (11) located in the rodless cavity on the piston (3), the first buffer sleeve (4) and the second buffer sleeve (11) are axially slidable along the piston rod (3);

the first buffer sleeve (4) is provided with a sealing end face (401), and the rod cavity end cap (1) is provided with a sealing end face (101), during an extending movement of the piston, the sealing end face (401) of the first buffer sleeve is capable of contacting with the sealing end face (101) of the rod cavity end cap (1) to form a sealing surface, and hydraulic oil located at a side of the sealing surface close to the piston is discharged into the oil passage (B) via the throttle oil channel (301*a*);

the second buffer sleeve (11) is provided with a sealing end face (111), and the rodless cavity end cap (12) is provided with a sealing end face (121); during a retracting movement of the piston, the sealing end face (121) of the second buffer sleeve is capable of contacting with the sealing end face (121) of the rodless cavity end cap (12) to form a sealing surface, and hydraulic oil located at a side of the sealing surface close to the piston is discharged into the oil passage (A) via the throttle oil channel (301*b*).

Preferably, the throttle oil channels (301*a*, 301*b*) are arranged linearly between the piston rod (3) and the buffer sleeves (4, 11) along axial direction.

Preferably, when the piston rod (3) extends to an end of a stroke, the first buffer sleeve (4) keeps a distance (L1) from an end point of its sliding towards the piston (6).

Preferably, when the piston rod (3) retracts to an end of a stroke, the second buffer sleeve (11) keeps a distance (L2) from an end point of its sliding towards the piston (6).

Preferably, when the sealing end face (401) of the first buffer sleeve (4) comes into contact with the sealing end face (101) of the rod cavity end cap (1) to form a sealing surface, an area of the first buffer sleeve (4) subjected to an axial action of hydraulic oil in the rod cavity is larger than an area of the first buffer sleeve (4) subjected to an axial action of hydraulic oil in the oil passage (B).

Preferably, when the sealing end face (111) of the second buffer sleeve (11) comes into contact with the sealing end face (121) of the rodless cavity end cap (12) to form a sealing surface, an area of the second buffer sleeve (11) subjected to an axial action of hydraulic oil in the rodless cavity is larger than an area of the second buffer sleeve (11) subjected to an axial action of hydraulic oil in the oil passage (A).

Preferably, the sealing end face (401) of the first buffer sleeve (4) comes into contact with the sealing end face (101) of the rod cavity end cap (1) to form a face seal or a line seal.

Preferably, the sealing end face (111) of the second buffer sleeve (11) comes into contact with the sealing end face (121) of the rodless cavity end cap (12) to form a face seal or a line seal.

Preferably, the cross-sectional area of the throttle oil channel (301*a*, 301*b*) becomes smaller as the buffer sleeve (4, 11) slides on the piston rod (3) towards the piston (6).

Preferably, an elastic element (5, 7) for returning the buffer sleeve (4, 11) is provided inside a cavity of the cylinder barrel (2).

Preferably, multiple circumferential balancing oil grooves (302*a*, 302*b*) are provided on a surface of the piston rod (3) fitted with the buffer sleeve (4, 11).

Preferably, the throttle oil channel (301*a*, 301*b*) is a throttle oil groove linearly arranged on an external surface of the piston rod (3) along an axial direction, and the cross-sectional area of the throttle oil channel (301*a*, 301*b*) decreases gradually towards the piston (6).

Preferably, the throttle oil channel (301*a*, 301*b*) is formed by a throttle inclined surface linearly arranged in a sliding region between the buffer sleeve (4, 11) and the piston rod (3) along an axial direction.

Preferably, the throttle oil channel (301*a*, 301*b*) includes: an oil channel (3013) arranged inside the piston rod (3) and extending in the axial direction; and a plurality of throttle orifices (3014) arranged on the external surface of the piston rod (3) along the axial direction being in communication with the oil channel (3013).

Preferably, the aperture diameters of the throttle orifices (3014) become smaller gradually towards the piston (6).

Preferably, the throttle oil channel (301*a*, 301*b*) includes a first segment of throttle oil channel (3012) located at an inlet end thereof, and a second segment of throttle oil channel (3011) located at an outlet end thereof. The first segment of throttle oil channel (3012) is a throttle oil groove arranged on a surface of the piston rod (3), and the second segment of throttle oil channel (3012) is an oil channel arranged inside the piston rod (3) or the buffer sleeve (4, 11).

Preferably, the cross-sectional area of the first segment of throttle oil channel (3012) becomes smaller gradually towards the piston (6).

Preferably, the piston rod (3) includes a piston rod body and a transition sleeve (304). The transition sleeve (304) is mounted on the piston rod body, and the buffer sleeve (4, 11) is arranged on the transition sleeve (304). The throttle oil channel (301*a*, 301*b*) is arranged on the transition sleeve (304).

Preferably, the piston rod (3) includes a piston rod body (3*a*) and a buffer shaft (3*b*). The piston rod body (3*a*) and the buffer shaft (3*b*) are connected with each other. The second buffer sleeve (11) is arranged on the buffer shaft (3*b*), and the throttle oil channel (301*b*) is arranged on the buffer shaft (3*b*).

The device associated with the hydraulic cylinder according to the embodiment of the present application may be a piston rod including a piston rod body segment in the rod cavity and a buffer shaft segment in the rodless cavity after being assembled. Both the piston rod body segment and the buffer shaft segment are provided with throttle oil channels extending linearly in the axial direction.

Preferably, the cross-sectional area of each of the throttle oil channels increases gradually from a side of the throttle oil channel close to the piston to the other side of throttle oil channel.

Preferably, a shaft shoulder for limiting the buffer sleeve (4) is provided on the piston rod body.

Preferably, a stop shoulder groove used for a stop shoulder for limiting the second buffer sleeve (11) is provided at a tail end of the buffer shaft segment of the piston rod (3) located in the rodless cavity.

The beneficial effects of the hydraulic cylinder according to the embodiment of the present application are as follows.

Firstly, the buffer sleeve is provided with a sealing end face, and the rodless cavity end cap and/or the rod cavity end cap are/is provided with a sealing end face. The two sealing end faces come into contact with each other to form a seal. The hydraulic oil in the rodless cavity and/or in the rod cavity is discharged into the oil passage via the throttle oil channel arranged on the buffer sleeve or on the piston rod. Therefore, the enclosed hydraulic oil generates an appropriate buffering pressure that acts on the oil discharging side of the piston, to counteract the inertial force of the piston so as to achieve the purpose of decelerating and braking. The throttle buffering of the mechanism is extremely smooth and reliable, so that the buffering mechanism is avoided from the mechanical failures. In the preferred embodiment, the flowing area of the throttle oil channel is variable, which achieves the purpose of throttle-varied buffering. The cooperation between the buffer sleeve, the piston rod and the throttle oil channel achieves the function of a variable throttle valve.

Secondly, when the piston rod retracts to the end of the stroke, the second buffer sleeve does not reach the end position and can still slide towards the piston by a certain distance. When the piston rod extends out, oil enters the oil passage A, and under the action of the hydraulic oil, the second buffer sleeve is pushed to slide towards the piston so as to compress a return spring, so that the sealing end face of the second buffer sleeve moves away from the sealing end face of the rodless cavity end cap. The oil passage A comes into direct communication with the rodless cavity, and the hydraulic oil enters into the rodless cavity and pushes the piston to move leftwards. The second buffer sleeve cooperates with the rodless cavity end cap to function as a check valve. In this way, the oil can enter the rodless cavity rapidly so as to push the piston to move. If the second buffer sleeve doesn't have the function of a check valve and the oil can not enter the rodless cavity rapidly, the piston rod is actuated to extend out slowly, even that the piston rod fails to perform the extending movement.

When the piston rod extends to the end of the stroke, the first buffer sleeve does not reach the end position, and can still slide towards the piston by a certain distance. When the piston rod retracts back, oil enters the oil passage B, and under the action of the hydraulic oil, the first buffer sleeve is pushed to slide towards the piston so as to compress a return spring, so that the sealing end face of the first buffer sleeve moves away from the sealing end face of the rod cavity end cap. The oil passage B comes into direct communication with the rod cavity, and the hydraulic oil enters into the rod cavity and pushes the piston to move. The first buffer sleeve cooperates with the rod cavity end cap to function as a check valve. In this way, the oil can enter the rod cavity rapidly so as to push the piston to move. If the first buffer sleeve doesn't have the function of a check valve, and the oil can not enter the rod cavity rapidly, the piston rod is actuated to retract slowly, even that the piston rod fails to perform the retracting movement.

Thirdly, in a hydraulic cylinder with a large cylinder diameter and a long stroke, it is very difficult merely by ways of spring force to form a reliable sealing surface between the buffer sleeve and the rodless cavity end cap, and this method is also not be the most preferred way. In the hydraulic cylinder according to the embodiment of the present application, when the piston rod retracts to a position being at a set distance from the end of the stroke, the rodless cavity end cap comes into contact with the second buffer sleeve, and the hydraulic oil in the rodless cavity is enclosed in the set oil cavity, causing an increased pressure of the hydraulic oil in the rodless cavity. Since the areas of the two sides of the second buffer sleeve subjected to the axial action of the hydraulic oil are different, i.e., the area of the second buffer sleeve subjected to the axial action of the hydraulic oil in the rodless cavity is larger than the area of the second buffer sleeve subjected to the axial action of the hydraulic oil in the oil passage A, pressure difference is generated between both sides of the second buffer sleeve. Under the action of the hydraulic oil, the second buffer sleeve is pushed to press against the rodless cavity end cap so as to form a seal. Thus, a reliable sealing surface is formed between the second buffer sleeve and the rodless cavity end cap. The hydraulic oil in the rodless cavity is discharged into the oil passage A via the throttle oil channel, therefore solving the problem that it is difficult to form a sealing surface.

When the piston rod 3 extends to a position being at a set distance from an end of the stroke, the rod cavity end cap comes into contact with the first buffer sleeve, and the hydraulic oil in the rod cavity is enclosed in the set oil cavity, resulting in an increased pressure of the hydraulic oil in the rod cavity. Since the areas of the two sides of the first buffer sleeve subjected to the axial action of the hydraulic oil are different, i.e. the area of the first buffer sleeve subjected to the axial action of the hydraulic oil in the rod cavity is larger than the area of the first buffer sleeve subjected to the axial action of the hydraulic oil in the oil passage B, pressure difference is generated between both sides of the first buffer sleeve. Under the action of the hydraulic oil, the first buffer sleeve is pushed to press against the rod cavity end cap so as to form a seal. Thus, a reliable sealing surface is formed between the first buffer sleeve and the rod cavity end cap. The hydraulic oil in the rod cavity is discharged into the oil passage B via the throttle oil channel, therefore solving the problem that it is difficult to form a sealing surface.

Fourthly, a return spring is provided between the buffer sleeve and the piston, which may, on the one hand, actuate the piston rod rapidly when retracting, and on the other hand, facilitate the buffering and returning between the buffer sleeve and the rod cavity and/or rodless cavity, and also facilitate the sealing.

Fifthly, multiple circumferential balancing oil grooves are provided on the surfaces of the buffer sleeve and the piston rod fitted with each other so as to improve the service life of the buffer sleeve and the piston rod.

Sixthly, throttle oil channels are designed as tapered linear throttle oil channels or formed by throttle inclined surfaces, so that the movement of the piston rod and the piston can be slowed down smoothly without too high transient pressure by variable throttling. This kind of structure is manufactured easily, has excellent buffering effect, as well as long service life.

Seventhly, in order to facilitate incorporating multiple circumferential balancing oil grooves and throttle oil channels with high precision into the piston rod, a transition sleeve is additionally provided on the piston rod, and the multiple circumferential balancing oil grooves and throttle oil channels are manufactured on the transition sleeve; or the piston rod can be divided into two segments to manufacture, the segment located in the rodless cavity can be manufactured separately and connected to the piston rod body by threading and the like.

DETAILED DESCRIPTION OF THE INVENTION

Figure 1:
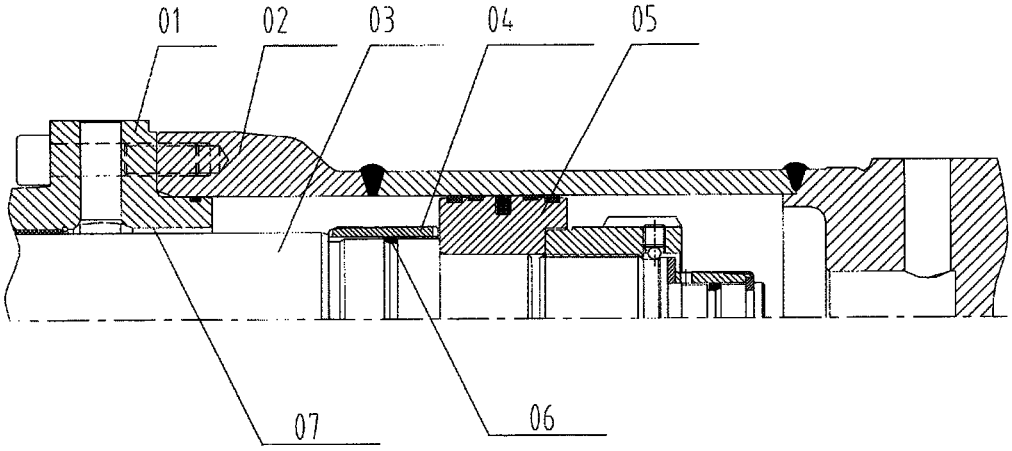
Fig. 1 Prior Art
FIG. 1 is a structural schematic view of a hydraulic cylinder in the prior art.
Figure 2:
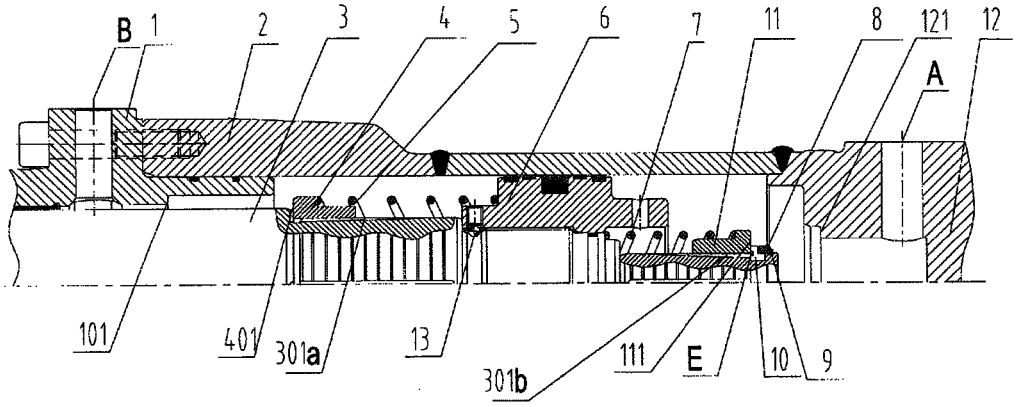
FIG. 2 is a structural schematic view of a hydraulic cylinder according to a first embodiment of the present application.
Figure 3:
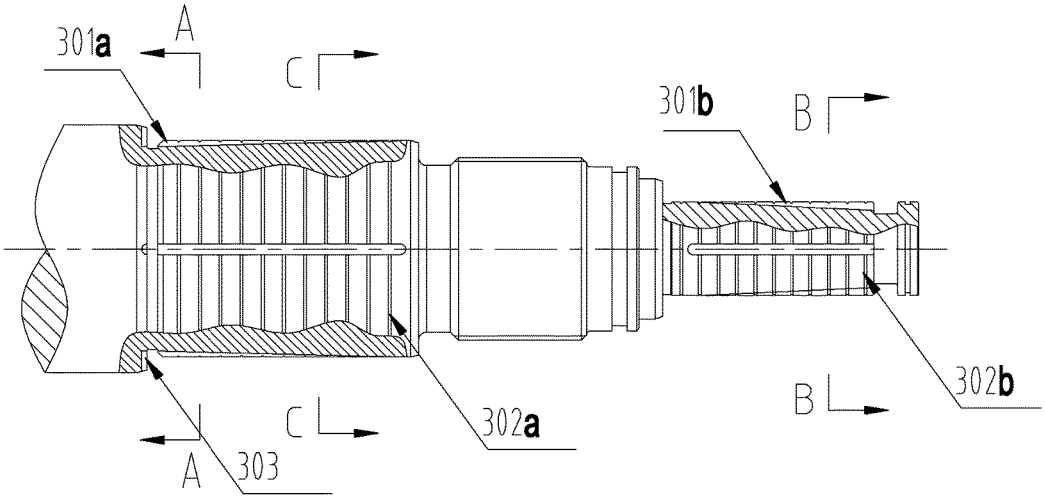
FIG. 3 is a structural schematic view of a piston rod part in FIG. 2.
Figure 4:
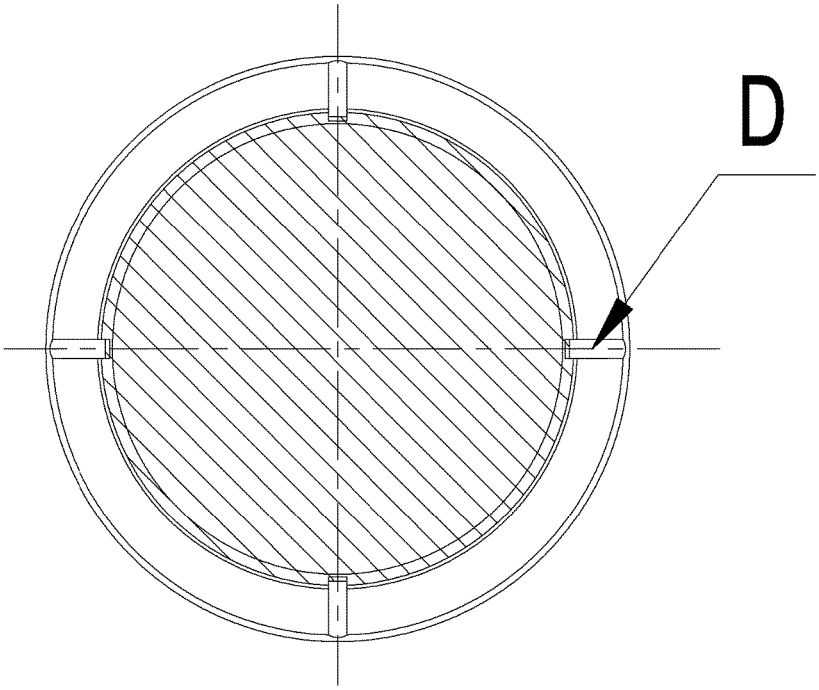
FIG. 4 is a view taken along line A-A of FIG. 3.
Figure 5:
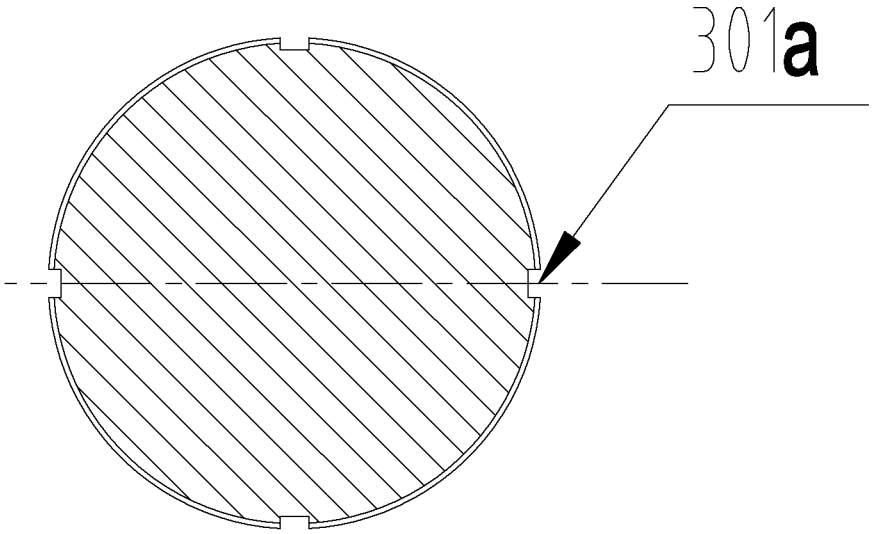
FIG. 5 is a view taken along line C-C of FIG. 3.
Figure 6:
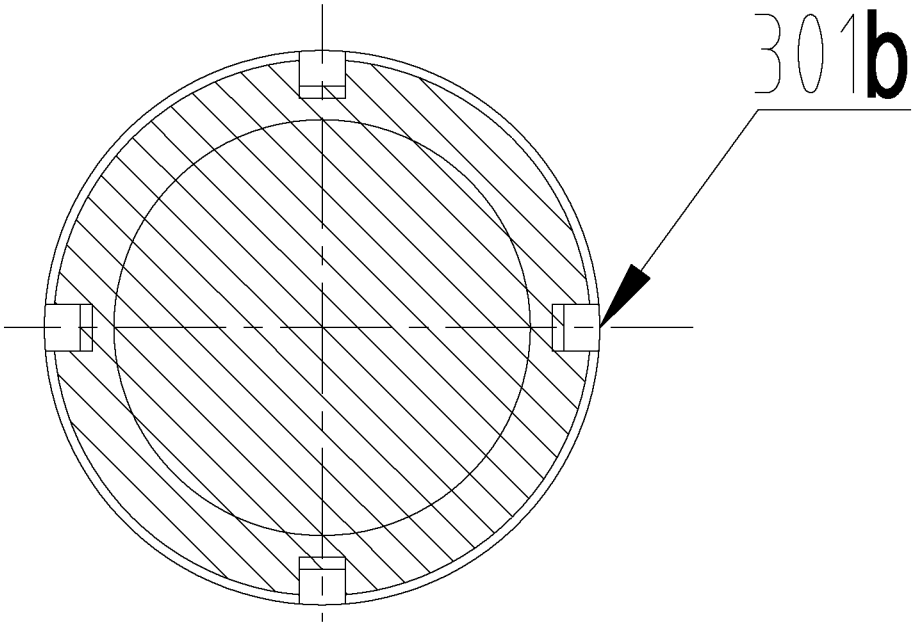
FIG. 6 is a view taken along line B-B of FIG. 3.
Figure 7:
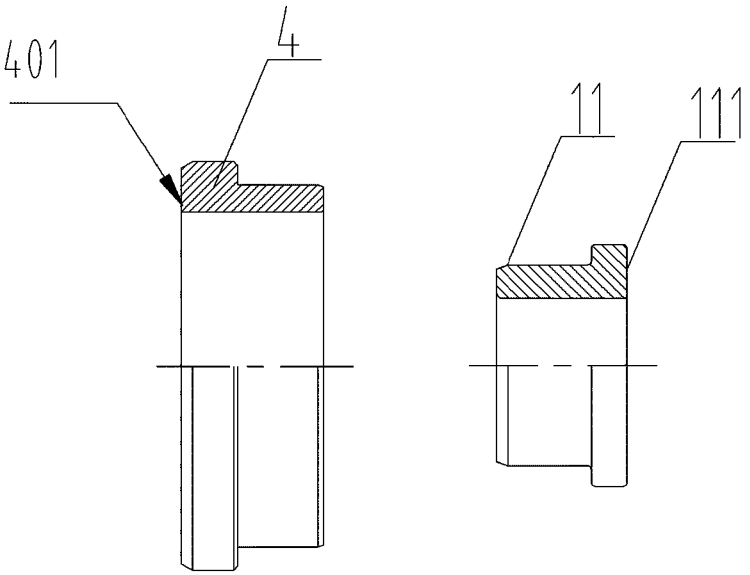
FIG. 7 is a structural schematic view of a buffer sleeve part in FIG. 2.
Figure 8:
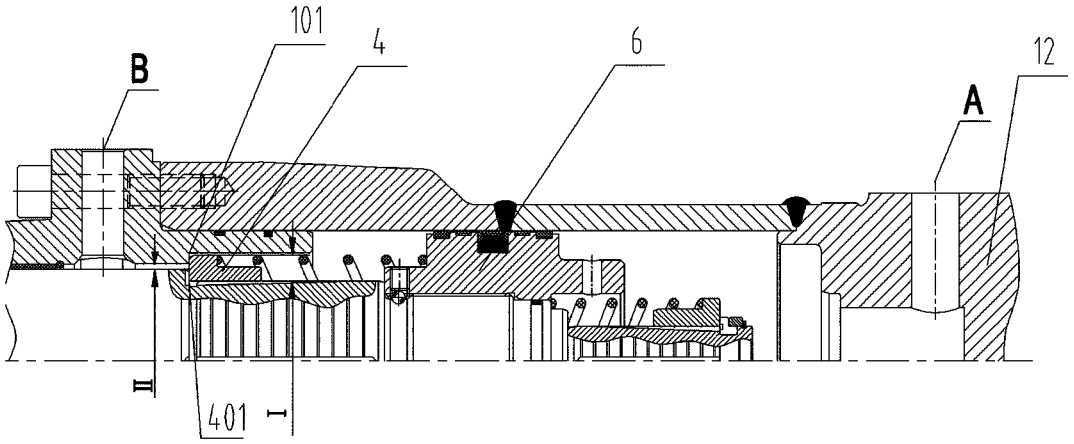
FIG. 8 is a structural schematic view of the hydraulic cylinder in FIG. 2 with a first buffer sleeve being in a buffering state.
Figure 9:
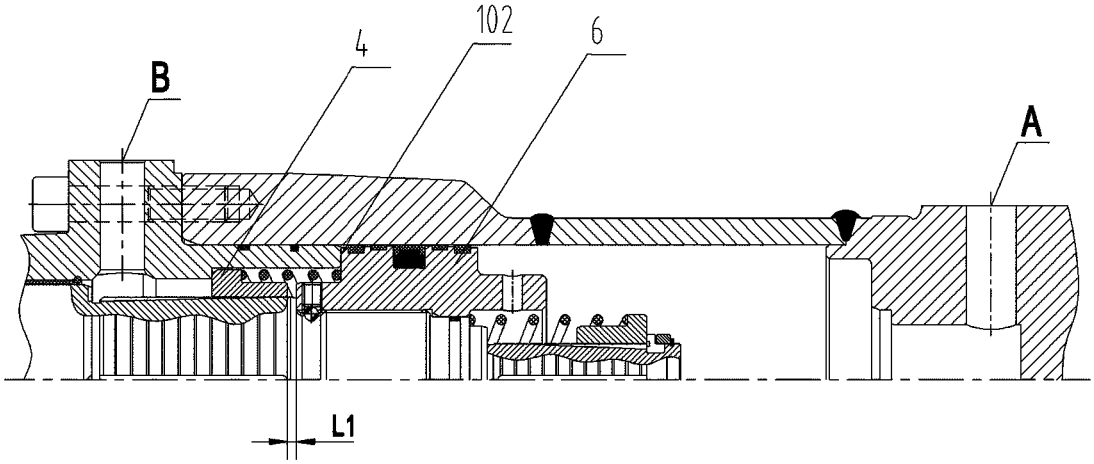
FIG. 9 is a structural schematic view of the hydraulic cylinder in FIG. 2 with the first buffer sleeve being in a buffering end state.
Figure 10:
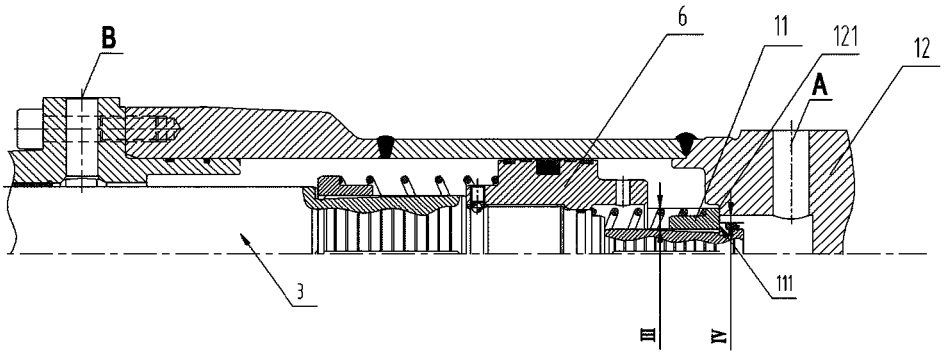
FIG. 10 is a structural schematic view of the hydraulic cylinder in FIG. 2 with a second buffer sleeve being in a buffering state.

In order that the technical solutions of the embodiment of the present application can be better understood by those skilled in the art, the embodiments of the present application will be described in detail in conjunction with the accompanying drawings and the specific embodiments hereinafter.

Reference is made to the first embodiment of FIGS. 2 to 11, which includes a rod cavity end cap 1, a cylinder barrel 2, a piston rod 3, a piston 6 and a rodless cavity end cap 12. The rod cavity end cap 1 is provided with an oil passage B, and the rodless cavity end cap 12 is provided with an oil passage A. The cavity of the cylinder barrel 2 is divided into a rod cavity and a rodless cavity by the piston rod 3 and the piston 6. The oil passages A and B are in communication with an oil circuit of the hydraulic system, and both are axial oil passages arranged in the hydraulic cylinder. The oil passage B includes an oil passage hole arranged in the rod cavity end cap 1 and an oil passage formed by a clearance between the piston rod 3 and the rod cavity end cap 1. The oil passage B extends to a sealing end face 101 of the rod cavity end cap 1.

The oil passage B includes the oil passage hole arranged in the rod cavity end cap 1, and the oil passage formed by a clearance between the piston rod 3 and the rod cavity end cap 1. The oil passage B extends to a sealing end face 101 of the rod cavity end cap 1. The oil passage B and the oil passage A can also be connected with each other directly.

The oil passage A extends to a sealing end face 121 of the rodless cavity end cap 12. A cavity for accommodating a buffer shaft 3*b* at a tail end of the piston rod 3 is provided in the rodless cavity end cap 12. The oil passage B and the oil passage A can also be connected with each other directly.

A first buffer sleeve 4 located in the rod cavity and a second buffer sleeve 11 located in the rodless cavity are provided on the piston rod 3, and both are axially slidable along the piston rod 3. An axial throttle oil channel 301*a* is provided between the first buffer sleeve 4 and the piston rod 3, and an axial throttle oil channel 301*b* is provided between the second buffer sleeve 11 and the piston rod 3. The throttle oil channels 301*a* and 301*b* can be implemented in various ways, the cross-section of which can be U-shaped, V-shaped, square or in any other shape.

The first buffer sleeve 4 is provided with a sealing end face 401 for sealing, and the rod cavity end cap 1 is provided with a sealing end face 101 cooperating with the sealing end face 401 to achieve sealing. The sealing end face 401 of the first buffer sleeve 4 can come into contact with the sealing end face 101 of the rod cavity end cap 1 to form a seal, which can break the direct communication between the oil passage B and the rod cavity entirely. The direct communication between the oil passage B and the rod cavity can also be broken partially.

The second buffer sleeve 11 is provided with a sealing end face 111 for sealing, and the rodless cavity end cap 12 is provided with a sealing end face 121 cooperating with the sealing end face 111 of the second buffer sleeve 11 to achieve sealing. The sealing end face 111 of the buffer sleeve 11 can come into contact with the sealing end face 121 of the rodless cavity end cap 12 to form a seal, which can break the direct communication between the oil passage A and the rodless cavity entirely. The direct communication between the oil passage A and the rodless cavity can also be broken partially.

Figure 16:
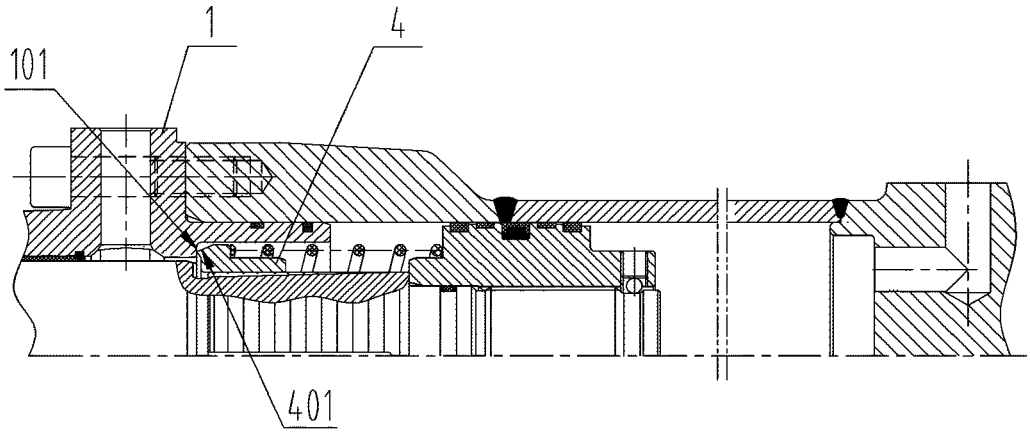
FIG. 16 is a structural schematic view of a hydraulic cylinder according to a sixth embodiment of the present application.
Figure 17:
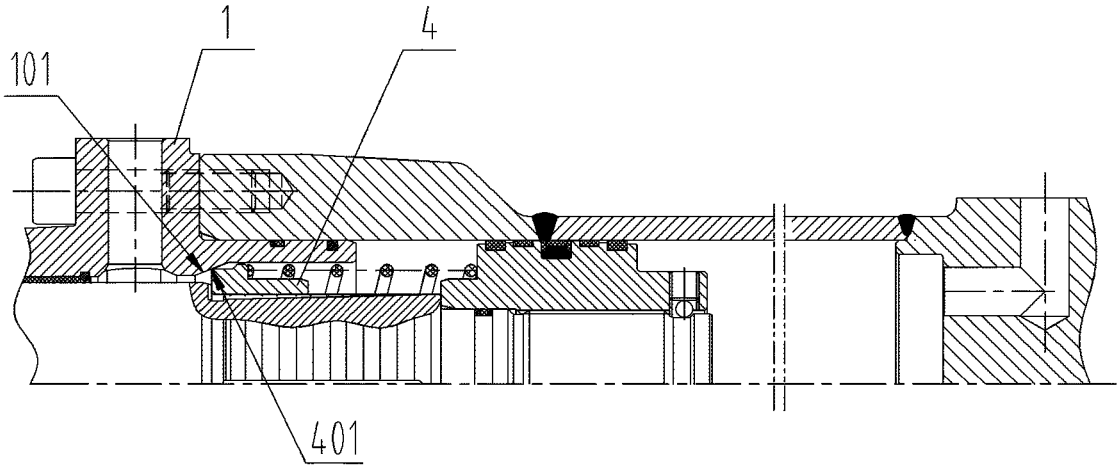
FIG. 17 is a structural schematic view of a hydraulic cylinder according to a seventh embodiment of the present application.
Figure 18:
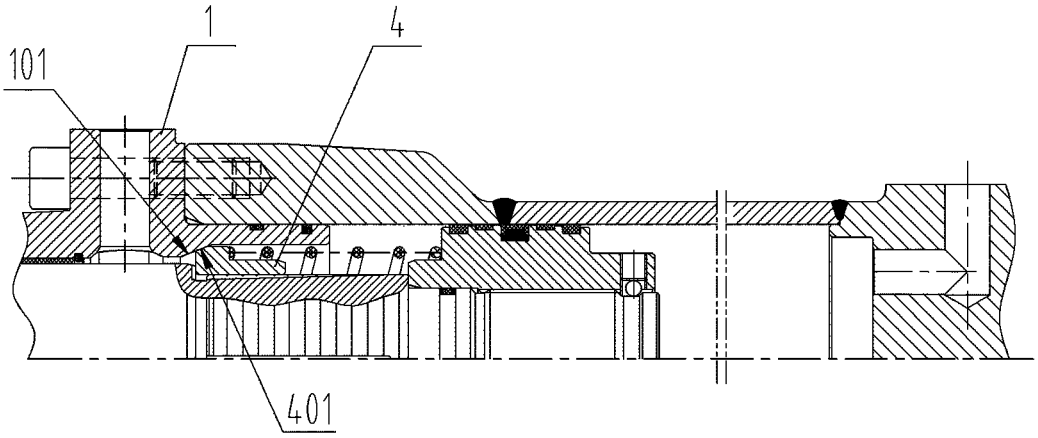
FIG. 18 is a structural schematic view of a hydraulic cylinder according to a eighth embodiment of the present application.

The sealing formed by the contact between the sealing end face 401 of the first buffer sleeve 4 and the sealing end face 101 of the rod cavity end cap 1 may be face sealing or line sealing. For example, in the first embodiment, the sealing end face 401 contacts the sealing end face 101 to form a plane seal; and in the sixth embodiment, as shown in FIG. 16, a line sealing ring is provided on the sealing end face 401, and configured to contact the sealing end face 101 to form a line seal. In the seventh embodiment, as shown in FIG. 17, the sealing end face 101 is a conical surface, and the sealing end face 401 contacts the sealing end face 101 to form a line seal. In the eighth embodiment, as shown in FIG. 18, both the sealing end face 401 and the sealing end face 101 are conical surfaces, and the two conical surfaces contact with each other to form a face seal. In addition to the above, other ways are also possible, for example, a curved face seal, or the like.

Figure 19:
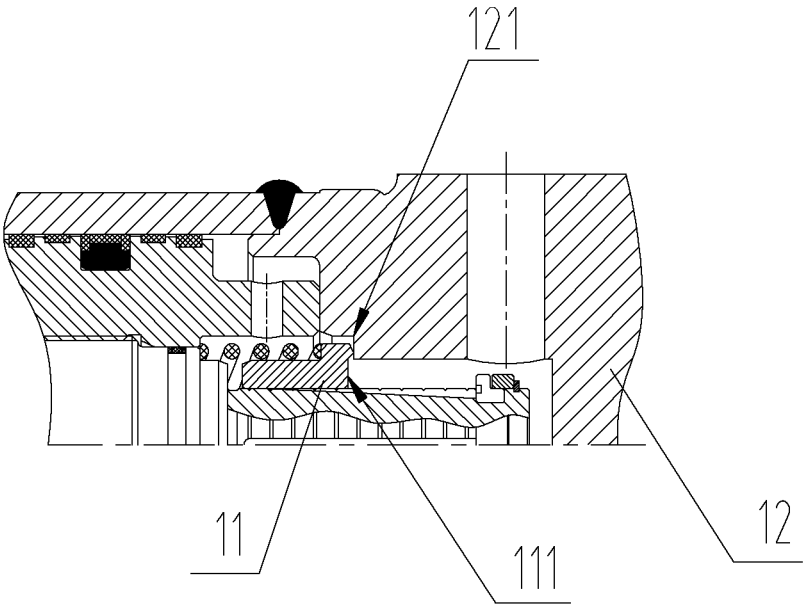
FIG. 19 is a structural schematic view of a hydraulic cylinder according to a ninth embodiment of the present application.
Figure 20:
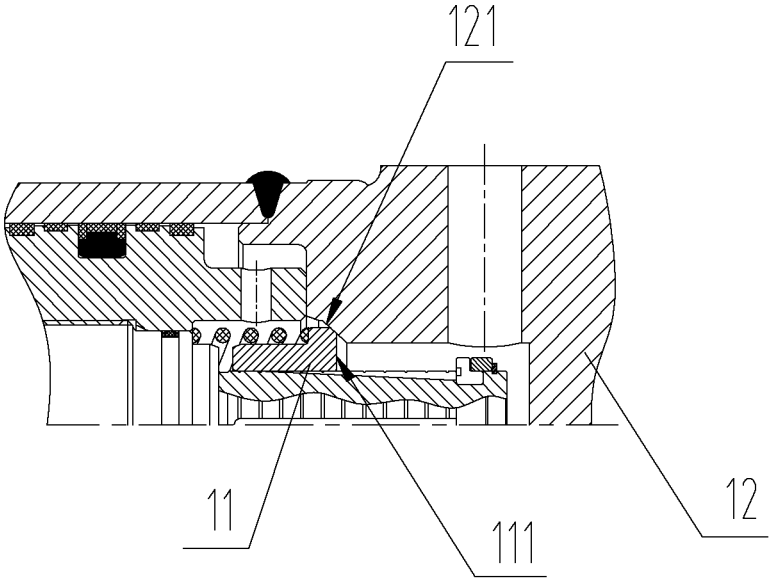
FIG. 20 is a structural schematic view of a hydraulic cylinder according to a tenth embodiment of the present application.
Figure 21:
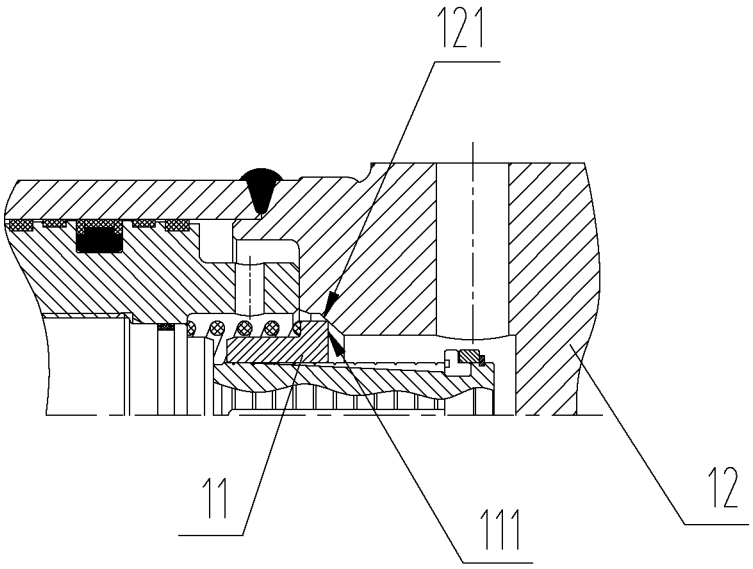
FIG. 21 is a structural schematic view of a hydraulic cylinder according to an eleventh embodiment of the present application.

Similarly, the sealing formed by the contact between the sealing end face 111 of the second buffer sleeve 11 and the sealing end face 121 of the rodless cavity end cap 12 can be face sealing or line sealing. For example, in the first embodiment, the sealing end face 111 contacts the sealing end face 121 to form a face seal; and in the ninth embodiment, as shown in FIG. 19, a line sealing ring is provided on the sealing end face 111, and configured to contact the sealing end face 121 to form a line seal. In the tenth embodiment, as shown in FIG. 20, both the sealing end face 111 and the sealing end face 121 are conical surfaces, and the two conical surfaces contact with each other to form a face seal. In the eleventh embodiment, as shown in FIG. 21, the sealing end face 121 is a conical surface, the sealing end face 111 contacts the sealing end face 121 to form a line seal.

When the piston rod 3 extends to a position being at a set distance from an end of the stroke, the rod cavity end cap 1 comes into contact with the first buffer sleeve 4, and the hydraulic oil in the rod cavity is enclosed in the set oil cavity, resulting in an increased pressure of the hydraulic oil in the rod cavity. Since the areas of the two sides of the buffer sleeve subjected to the axial action of the hydraulic oil are different, i.e. the area of the first buffer sleeve 4 subjected to the axial action of the hydraulic oil in the rod cavity is larger than the area of the first buffer sleeve 4 subjected to the axial action of the hydraulic oil in the oil passage B, pressure difference is generated between both sides of the first buffer sleeve 4.

Under the action of the hydraulic oil, the first buffer sleeve 4 is pushed to press against the rod cavity end cap 1 so as to form a seal. Thus, a reliable sealing surface is formed between the first buffer sleeve 4 and the rod cavity end cap 1. The hydraulic oil in the rod cavity is discharged into the oil passage B via the throttle oil channel 301*a*, therefore solving the difficulty in forming a sealing surface.

Similarly, when the piston rod 3 retracts back to a position being at a set distance from the other end of the stroke, the rodless cavity end cap 12 comes into contact with the second buffer sleeve 11, and the hydraulic oil in the rodless cavity is enclosed in the set oil cavity, resulting in an increased pressure of the hydraulic oil in the rodless cavity. Since the areas of the two sides of the second buffer sleeve 11 subjected to the axial action of the hydraulic oil are different, i.e., the area of the second buffer sleeve 11 subjected to the axial action of the hydraulic oil in the rodless cavity is larger than the area of the second buffer sleeve 11 subjected to the axial action of the hydraulic oil in the oil passage A, pressure difference is generated between both sides of the second buffer sleeve 11. Under the action of the hydraulic oil, the second buffer sleeve 11 is pushed to press against the rodless cavity end cap 12 so as to form a seal. Thus, a reliable sealing surface is formed between the second buffer sleeve 11 and the rodless cavity end cap 12. The hydraulic oil in the rodless cavity is discharged into the oil passage A via the throttle oil channel 301*b*, therefore solving the difficulty in forming a sealing surface.

After the sealing end face 401 of the first buffer sleeve 4 comes into contact with the sealing end face 101 of the rod cavity end cap 1 to form a seal, the direct communication between the oil passage B and the rod cavity is broken entirely. The direct communication between the oil passage B and the rod cavity can also be broken partially. The hydraulic oil in the rod cavity is discharged into the oil passage B via the throttle oil channel 301*a*. Since the oil discharging quantity of the throttle oil channel 301*a* is rather small, the enclosed hydraulic oil generates an appropriate buffering pressure that acts on the oil discharging side of the piston 6 to counteract the inertial force of the piston, so as to achieve the purpose of decelerating or braking The throttle buffering is extremely smooth and reliable, thereby avoiding the buffering mechanism from mechanical failures.

Similarly, the sealing end face 111 of the second buffer sleeve 11 comes into contact with the sealing end face 121 of the rodless cavity end cap 12 to form a seal, and the direct communication between the oil passage A and the rodless cavity is broken entirely. The direct communication between the oil passage A and the rodless cavity can also be broken partially. The hydraulic oil in the rodless cavity is discharged into the oil passage A via the throttle oil channel 301*b*. Since the oil discharging quantity of the throttle oil channel 301*b* is rather small, the enclosed hydraulic oil generates an appropriate buffering pressure that acts on the oil discharging side of the piston 6 to counteract the inertial force of the piston, so as to achieve the purpose of decelerating or braking The throttle buffering is extremely smooth and reliable, thereby avoiding the buffering mechanism from mechanical failures.

For the structure of the throttle oil channel 301*a* or 301*b*, if the cross-sectional area of the throttle oil channel 301*a* or 301*b* (i.e. the flowing area) is constant during the buffering process of the hydraulic cylinder, the throttle oil channel 301*a* or 301*b* is referred to as a constant throttle oil channel; and if the flowing area is variable automatically during the buffering process of the hydraulic cylinder, the throttle oil channel 301*a* or 301*b* is referred to as a variable throttle oil channel. There are various forms to be selected as set forth below.

In the first embodiment of the present application, the throttle oil channels 301*a*, 301*b* are arranged in the sliding regions between the piston rod 3 and the first buffer sleeve 4, the second buffer sleeve 11 (i.e. the throttle oil channel 301*a* is arranged in the sliding region between the piston rod 3 and the first buffer sleeve 4, and the throttle oil channel 301*b* is arranged in the sliding region between the piston rod 3 and the second buffer sleeve 11). The throttle oil channels 301*a*, 301*b* are tapered linear throttle oil grooves, with the depth of the throttle oil grooves decreasing gradually towards the piston 6. Four throttle oil grooves are evenly distributed on the external surface of the piston rod 3 to achieve a throttling-varied smooth buffering effect.

Figure 11:
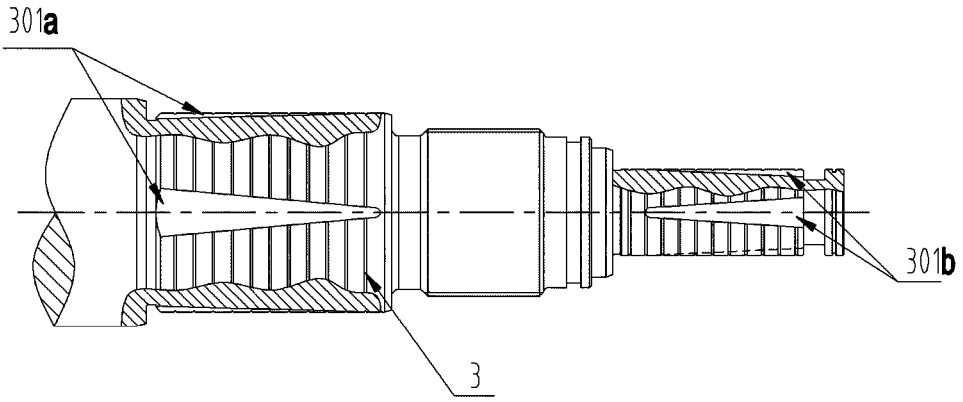
FIG. 11 is a structural schematic view of the hydraulic cylinder in FIG. 2 with the second buffer sleeve being in a buffering end state.

In the second embodiment of the present application (as shown in FIG. 11), the throttle oil channels 301*a*, 301*b* are formed by throttle inclined surfaces arranged on the piston rod 3 respectively. The throttle inclined surface rises gradually towards the piston, i.e.

the cross-sectional area of the throttle inclined surface decreases gradually towards the piston, so as to achieve a throttling-varied smooth buffering effect.

Figure 14:
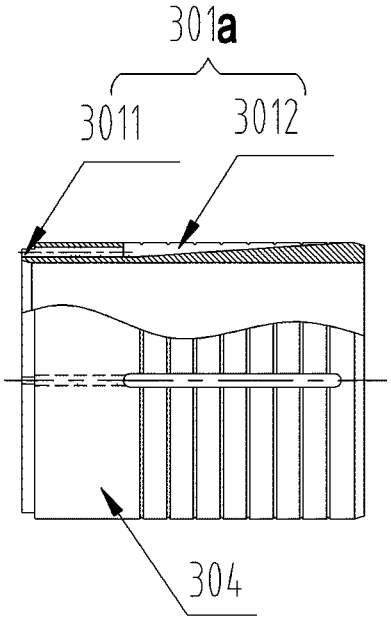
FIG. 14 is a structural schematic view of a hydraulic cylinder according to a fourth embodiment of the present application.

In the fifth embodiment of the present application (as shown in FIG. 14), a transition sleeve 304 is provided in the sliding region between the piston rod 3 and the first buffer sleeve 4. The throttle oil channel 301*a* arranged on the transition sleeve 304 includes a first segment of throttle oil channel 3012 located at an inlet end of the transition sleeve 304, and a second segment of throttle oil channel 3011 located at an outlet end of the transition sleeve 304. The first segment of throttle oil channel 3012 is a tapered linear throttle oil groove arranged on the transition sleeve 304, with the depth of the oil groove decreasing towards the piston 6; and the second segment of throttle oil channel 3011 is an oil passage arranged inside the transition sleeve 304, thereby achieving a throttling-varied smooth buffering effect.

Figure 15:
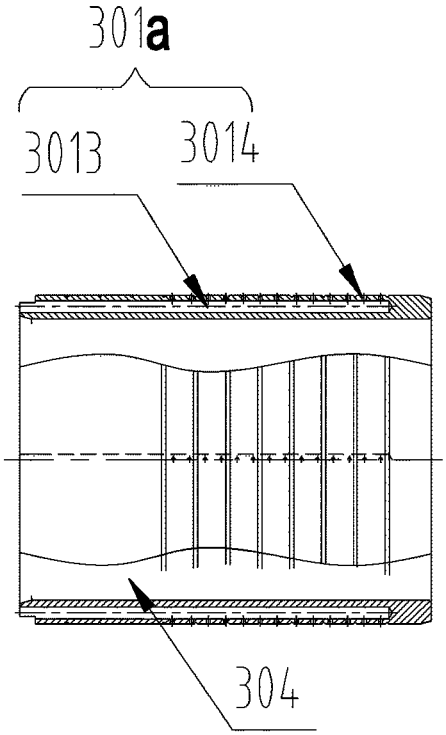
FIG. 15 is a structural schematic view of a hydraulic cylinder according to a fifth embodiment of the present application.

In the sixth embodiment of the present application (as shown in FIG. 15), a transition sleeve 304 is provided in the sliding region between the piston rod 3 and the first buffer sleeve 4. The throttle oil channel 301*a* arranged on the transition sleeve 304 includes an oil channel 3013 arranged inside the transition sleeve 304 and extending in the axial direction, and multiple throttle orifices 3014 arranged on the external surface of the transition sleeve 304 along the axial direction of the transition sleeve 304 and being in communication with the oil channel 3013. When the first buffer sleeve 4 slides towards the piston 6, the number of the throttle orifices 3014 that are covered by the first buffer sleeve 4 increases gradually, so that the flowing area of the throttle oil channel 301*a* decreases gradually, thereby achieving a throttling-varied smooth buffering effect. The aperture diameter of the throttle orifices 3014 can also decrease gradually towards the piston 6, so as to achieve the purpose of a constant deceleration.

In addition to the above illustrative embodiments, the throttle oil channels 301*a*, 301*b* may also be constant throttle oil channel and may be arranged on the first buffer sleeve 4 and the second buffer sleeve 11 respectively. The cross-sectional areas of the throttle oil channels 301*a* and 30 lb gradually decrease in depth and/or in width towards the piston. In the embodiments of the present application, the throttle oil channels 301*a*, 301*b* are arranged in the areas where the first buffer sleeve 4, the second buffer sleeve 11 are slidable with respect to the piston rod 3, and the throttle oil channels 301*a*, 301*b* are tapered linear throttle oil grooves, with the depth of the throttle oil grooves decreasing towards the piston 6. Compared with the helical throttle oil channel with variable depth, the throttle oil channels 301*a* and 301*b* are processed at a lower cost. Since the processing of the helical throttle oil channel with variable depth is extremely difficult, the processing cost is rather higher, and the processing precision of the helix depth is beyond control, therefore failing to achieve the ideal buffering effect. It is easy to process the tapered linear throttle oil groove and to control the processing precision of the taper, and the ideal buffering effect can be achieved. The first embodiment of the present application is the most preferred embodiment.

When the piston rod 3 extends out to the end of the stroke, the first buffer sleeve 4 does not reach the end position, and can still slide towards the piston by a certain distance L1. When the piston rod 3 retracts, oil enters the oil passage B; under the action of the hydraulic oil, the first buffer sleeve 4 is pushed to slide towards the piston 6 so as to compress a return spring 5; thus the sealing end face 401 of the first buffer sleeve 4 moves away from the sealing end face 101 of the rod cavity end cap 1, so that the oil passage B comes into direct communication with the rod cavity; and the hydraulic oil enters into the rod cavity and pushes the piston 6 to move. During the retracting movement of the piston rod 3, the first buffer sleeve 4 cooperates with the rod cavity end cap 1 to function as a check valve. The first buffer sleeve 4 keeps a distance L1 from the end point of its sliding towards the piston 6. The larger the distance L1 is, the longer the distance between the sealing end face 401 of the first buffer sleeve 4 and the sealing end face 101 of the rod cavity end cap 1 is, the more the flow of the hydraulic oil entering into the rod cavity is. The smaller the distance L1 is, the shorter the distance between the sealing end face 401 of the first buffer sleeve 4 and the sealing end face 101 of the end cap 1 of the rod cavity is, the less the flow of the hydraulic oil entering into the rod cavity is. The distance L1 must allow the oil passage B to be in direct communication with the rod cavity.

When the piston rod 3 retracts to the end of the stroke, the second buffer sleeve 11 does not reach the end position, and can still slide towards the piston by a certain distance L2. When the piston rod 3 extends out, oil enters the oil passage A; under the action of the hydraulic oil, the second buffer sleeve 11 is pushed to slide towards the piston 6 so as to compress a return spring 7; thus the sealing end face 111 of the second buffer sleeve 11 moves away from the sealing end face 121 of the rodless cavity end cap 12, so that the oil passage A comes into direct communication with the rodless cavity; and the hydraulic oil enters into the rodless cavity and pushes the piston 6 to move. During the extending movement of the piston rod 3, the second buffer sleeve 11 cooperates with the rodless cavity end cap 12 to function as a check valve. The second buffer sleeve 11 keeps a distance L2 from the end point of its sliding towards the piston 6. The larger the distance L2 is, the longer the distance between the sealing end face 111 of the second buffer sleeve 11 and the sealing end face 121 of the rodless cavity end cap 12 is, the more the flow of the hydraulic oil entering into the rodless cavity is. The smaller the distance L2 is, the shorter the distance between the sealing end face 111 of the second buffer sleeve 11 and the sealing end face 121 of the rodless cavity end cap 12 is, the less the flow of the hydraulic oil entering into the rodless cavity is. The distance L2 must be sufficient to allow the oil passage A to be in direct communication with the rodless cavity.

In order to enable the smooth slide of the first buffer sleeve 4 and the second buffer sleeve 11 on the piston rod 3 so as to assure the service life and the performance, multiple circumferential balancing oil grooves 302*a*, 302*b* are provided between the two buffer sleeves and the piston rod 3, i.e. multiple circumferential balancing oil grooves 302*a* are provided between the first buffer sleeve 4 and the piston rod 3, and multiple circumferential balancing oil grooves 302*b* are provided between the second buffer sleeve 11 and the piston rod 3. The balancing oil grooves 302*a*, 302*b* are provided on the external surface of the piston rod 3. Alternatively, the balancing oil grooves 302*a*, 302*b* may be arranged on the internal surfaces of the first buffer sleeve 4 and the second buffer sleeve 11, i.e. the balancing oil grooves 302*a* are arranged on the internal surface of the first buffer sleeve 4, and the balancing oil grooves 302*b* are provided on the internal surface of the second buffer sleeve 11. External surfaces of the piston rod 3 fitted with the first and second buffer sleeves 4, 11 can be treated with chromium plating so as to improve the hardness and the surface quality.

In order to reliably locate the first buffer sleeve 4, a shaft shoulder 303 for locating the first buffer sleeve 4 is provided on the piston rod 3. A return spring 5 is provided between the first buffer sleeve 4 and the piston 6 in order to ensure the significant buffering effect of the hydraulic cylinder and a quick return of the piston 6. One end of the return spring 5 abuts against the piston 6 and the other end abuts against the first buffer sleeve 4. The return spring 5 is adapted to return and buffer the first buffer sleeve 4. When the hydraulic cylinder is out of the buffer state, the first buffer sleeve 4 abuts against the shaft shoulder 303 under the applied force of the return spring 5. The shaft shoulder 303 is provided with an oil discharging groove D which is in communication with the throttle oil channel 301*a*. In order to locate the first buffer sleeve 4 on the piston rod 3, structures such as a retainer ring may also be arranged on the piston rod 3.

In order to reliably limit the second buffer sleeve 11, a stop shoulder for limiting the second buffer sleeve 11 is provided at the tail end of the piston rod 3. The stop shoulder includes a key 10, a key cap 8 and a retainer ring 9. The key 10 is of two-semicircular ring structure, and is assembled in a corresponding stop shoulder groove at the tail end of the piston rod 3. The key cap 8 is located between the key 10 and the retainer ring 9 and is adapted to fix the key 10. The retainer ring 9 is adapted to locate the key cap 8. The cross section of the key 10 is of an "L" shape, and an oil discharging groove E is arranged on the external surface of the key 10. The cross section of the key cap is of a square shape. The second buffer sleeve 11 and the hydraulic oil apply a very large force to the key 10. In order to prevent the applied force from causing damages to the key cap 8 and the retainer ring 9, the cross section of the key 10 is designed into an "L" shape, and the cross section of the key cap 8 is designed into a square shape, so that an applied force is transmitted onto the piston rod 3 via the key 10 of "L" shape. Therefore, the problem that the second buffer sleeve 11 and the hydraulic oil exert a very large force on the key 10 to cause damages to the key cap 8 and the retainer ring 9 is solved.

The piston 6 may be connected to the piston rod 3 by means of threading. For example, the piston 6 is fixed on the undercut of the piston rod 3 via a screw 13, and is sealed against the piston rod 3 via a stationary sealing-ring. The rod cavity end cap 1 and the cylinder barrel 2 are connected by means of bolting, while the rodless cavity end cap 12 and the cylinder barrel 2 are connected by welding. Various ways may be selected to connect the rod cavity end cap 1 and the rodless cavity end cap 12 with the cylinder barrel 2. For example, both the rod cavity end cap 1 and the rodless cavity end cap 12 can be connected to the cylinder barrel 2 by means of welding or bolting or threading, or they can be produced as an integrated structure as well.

Seals between the cylinder barrel 2 and the rod cavity end cap 1, as well as between the cylinder barrel 2 and the rodless cavity end cap 12 can be achieved via a sealing part (K08-D) being of an O-ring adding Glyd-ring form. The rod cavity end cap 1 is provided with a stop shoulder 102 adapted to limit a leftward movement of the piston 6; and the rodless cavity end cap 12 is provided with a stop shoulder adapted to limit a rightward movement of the piston 6.

The working process of the hydraulic cylinder is described as follows: when the piston rod 3 extends out, the piston 6 moves leftwards; when the piston rod 3 is at an end position of the retraction stroke, the second buffer sleeve 11 and the rodless cavity end cap 12 are in a contact sealed state; in order that the rodless cavity can be fed with oil rapidly, the piston rod 3 is pushed to perform the extending movement. There's still a distance L2 between the second buffer sleeve 11 and the end point of its sliding towards the piston 6; and under the action of the hydraulic oil, the second buffer sleeve 11 compresses a spring 7 and slides towards the piston 6. Therefore, the sealing end face 111 of the second buffer sleeve 11 moves away from the sealing end face 121 of the rodless cavity 12. At this moment, the second buffer sleeve 11 cooperates with the rodless cavity end cap 12 to function as a check valve.

Hydraulic oil enters into the rodless cavity and pushes the piston 6 to move leftwards. The hydraulic oil in the rod cavity is discharged via the oil passage B; when the piston rod 3 extends to a position away from the end of the stroke by a certain distance, the end face 401 of the first buffer sleeve 4 comes into contact with the end face 101 of the rod cavity to form a seal, breaking the direct communication between the oil passage B and the rod cavity entirely or partially. Hydraulic oil within the rod cavity is discharged through a throttle oil channel 301*a* and an oil discharging groove D to the oil passage B, with the throttle oil channel 301*a* being between the first buffer sleeve 4 and the piston rod 3. Since the oil discharging quantity of the throttle oil channel 301*a* is rather small, an appropriate buffer pressure being generated in the enclosed hydraulic oil is applied on the oil discharging side of the piston 6, to counteract with the inertial force of the piston. Thus, the hydraulic cylinder starts to enter into a buffer state in the left side. As the piston rod 3 further extends out, the piston 6 keeps on moving leftwards; the first buffer sleeve 4 slides rightwards with respect to the piston rod 3, so that the flowing area of the throttle oil channel 301*a* between the first buffer sleeve 4 and the piston rod 3 decreases gradually; the oil discharging quantity decreases as well; the buffer pressure generated in the rod cavity and applied on the oil discharging side of the piston 6 increases gradually; and the movement of the piston 6 is slowed down, thus achieving the object of decelerating and braking and realizing the effect of smooth buffering deceleration. When the left end face of the piston 6 abuts against the stop shoulder 102 of the rod cavity end cap 1, the piston 6 does not move leftwards any more, and the piston rod 3 extends to the end of the stroke. Thus, the whole buffer process is over.

When the piston rod 3 retracts back, the piston 6 moves rightwards. When the piston rod 3 is at an end position of the extending stroke, the first buffer sleeve 4 and the rod cavity end cap 1 are in a contact sealed state; and in order that the rod cavity can be fed with oil rapidly, the piston rod 3 is pushed to perform the retracting movement. There's still a distance L1 between the first buffer sleeve 4 and the end point of its sliding towards the piston 6; and under the action of the hydraulic oil, the first buffer sleeve 4 compresses a spring 5 and slides towards the piston 6. Therefore, the sealing end face 401 of the first buffer sleeve 4 moves away from the sealing end face 101 of the rod cavity 1. At this moment, the first buffer sleeve 4 cooperates with the rod cavity end cap 1 to function as a check valve during the retracting process of the piston rod 3.

The hydraulic oil enters into the rod cavity through the oil passage B and pushes the piston 6 to move rightwards, and the piston rod 3 retracts back. The hydraulic oil in the rodless cavity is discharged through the oil passage A; when the piston rod 3 retracts to a position away from the end of the stroke by a certain distance, the end face 111 of the second buffer sleeve 11 comes into contact with the end face 121 of the rodless cavity end cap to form a seal, breaking the direct communication between the oil passage A and the rodless cavity entirely or partially. Hydraulic oil within the rodless cavity is discharged through an throttle oil channel 301*b* and an oil discharging groove E to the oil passage A, with the throttle oil channel 301*b* being between the second buffer sleeve 11 and the piston rod 3. Since the oil discharging quantity of the throttle oil channel 301*b* is rather small, an appropriate buffer pressure generated in the enclosed hydraulic oil is applied on the oil discharging side of the piston 6, to counteract with the inertial force of the piston. Thus, the hydraulic cylinder starts to enter into a buffer state. As the piston rod 3 further retracts back, the piston 6 keeps on moving rightwards, the second buffer sleeve 11 slides leftwards with respect to the piston rod 3, so that the flowing area of the throttle oil channel 301*b* between the second buffer sleeve 11 and the piston rod 3 decreases gradually; the oil discharging quantity decreases as well; the buffer pressure generated in the rodless cavity and applied on the oil discharging side of the piston 6 increases gradually; and the movement of the piston 6 is slowed down, thus achieving the object of decelerating and braking and realizing the effect of smooth buffering deceleration. When the right end face of the piston 6 abuts against the stop shoulder of the rodless cavity end cap 12, the piston 6 does not move rightwards any more, and the piston rod 3 retracts to the end of the stroke. Thus, the whole buffer process is over.

Figure 12:
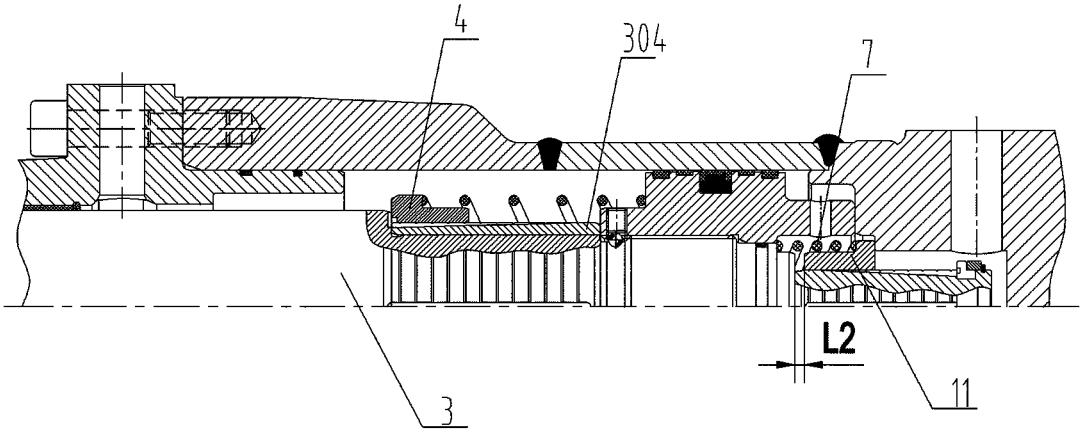
FIG. 12 is a structural schematic view of a hydraulic cylinder according to a second embodiment of the present application.

Reference is made to the third embodiment of the FIG. 12, which is a modification based on the above first embodiment. The third embodiment is different from the first embodiment in that: a transition sleeve 304 is mounted at a position where the piston rod 3 is fitted with the first buffer sleeve 4, and the transition sleeve 304 is fitted with the first buffer sleeve 4. Multiple circumferential balancing oil grooves and tapered linear throttle oil grooves are provided on the external surface of the transition sleeve 304, and the external surface of the transition sleeve 304 fitted with the first buffer sleeve 4 can be treated with chromium plating so as to improve the hardness and the surface quality.

In the first embodiment, multiple circumferential balancing oil grooves and tapered linear throttle oil grooves are processed on the piston rod 3 directly. Since the piston rod 3 has a large diameter and a long stroke, there are high precision requirements for processing the multiple circumferential balancing oil grooves and tapered linear throttle oil grooves, and the processing is extremely difficult. In the third embodiment, it is relatively easy to process multiple circumferential evenly-distributed balancing oil grooves and tapered linear throttle oil grooves at a high precision on the transition sleeve 304.

Figure 13:
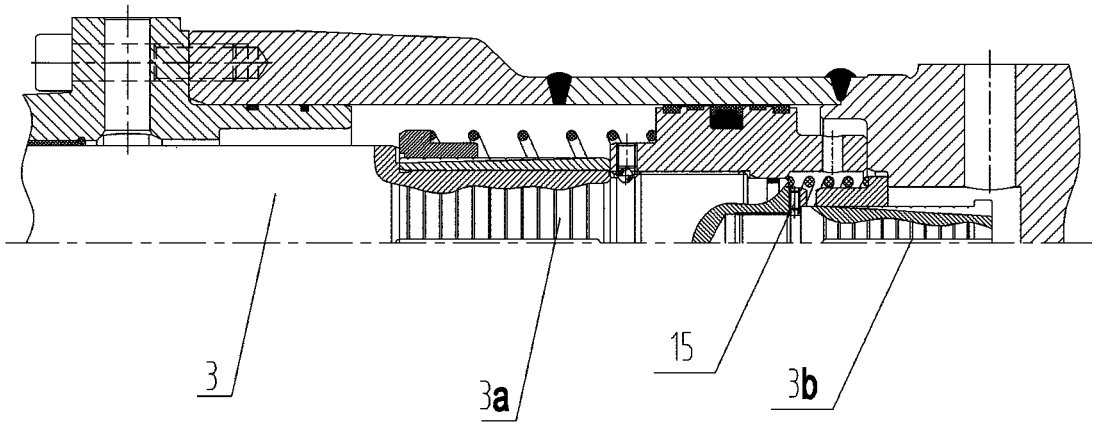
FIG. 13 is a structural schematic view of a hydraulic cylinder according to a third embodiment of the present application.

Reference is made to the fourth embodiment in FIG. 13, which is a modification based on the above first embodiment. The fourth embodiment is different from the first embodiment in that: the piston rod 3 includes a piston rod body 3*a* and a buffer shaft 3*b*, and the piston rod body 3*a* and the buffer shaft 3*b* are connected by threading and then fixed via a screw 15. The buffer shaft 3*b* is fitted with the buffer sleeve 11, and a shaft shoulder for limiting the buffer sleeve 11 is provided at a tail end of the buffer shaft 3*b*. Since the buffer shaft 3*b* has a short length, it is relatively easy to process multiple circumferential balancing oil grooves and tapered linear throttle oil grooves at a high precision on the buffer shaft 3*b*. The piston rod body 3*a* and the buffer shaft 3*b* may be connected together in various ways, for example, by threading, welding, bolting, and the like, as descried herein.

In the above embodiments, if there is a need for buffering in the rod cavity of the hydraulic cylinder, a buffer sleeve can be arranged only in the rod cavity; if there is a need for buffering in the rodless cavity of the hydraulic cylinder, a buffer sleeve can be arranged only in the rodless cavity; if there is a need for buffering in both the rod cavity and the rodless cavity, buffer sleeves can be arranged in the rod cavity and the rodless cavity respectively. Two or more buffer sleeves may also be arranged in one cavity, depending on actual demands. Multiple circumferential balancing oil grooves and multiple throttle oil channels extending axially may also be arranged on the internal surface of the buffer sleeves, and the cross-sectional area of the throttle oil channel may be constant.

In the above embodiments, a return spring may be provided between the buffer sleeves and the piston, and may also not to be provided, because the buffer sleeve comes into contact with the rod cavity end cap to form a seal under the action of the hydraulic oil.

In the hydraulic cylinder according to the embodiment of the present application, in addition to the above embodiments, the throttle oil channel can also be arranged on the rod cavity end cap, the rodless cavity end cap, the buffer sleeve and the piston rod. All such modifications are within the protection scope of the present application.

When the hydraulic cylinder according to the embodiment of the present application is employed in a hydraulic buffer system to replace the existing oil cylinder, the embodiment of the hydraulic buffer system of the present application can be achieved.

When the hydraulic cylinder according to the embodiment of the present application is employed in an excavator, the embodiment of the excavator of the present application can be achieved.

When the hydraulic cylinder according to the embodiment of the present application is employed in a concrete pump truck, the embodiment of the concrete pump truck of the present application can be achieved. The hydraulic cylinder according to the embodiment of the present application may also be employed in construction machinery of other types.

Although the embodiments of the present application are disclosed above by the preferred embodiments, these preferred embodiments are not intended to limit the application. Any skills in the art can make possible variations and modifications without departing from the spirit and scope of the present application, and the scope of protection of the present application should be defined by the claims of the present application.

The invention claimed is:

1. A hydraulic cylinder comprising a rod cavity end cap, a cylinder barrel, a piston rod, a piston, and a rodless cavity end cap, the rod cavity end cap being provided with an oil passage, and the rodless cavity end cap being provided with an oil passage, wherein:

at least two throttle oil channels are further provided, and at least two buffer sleeves are provided on the piston rod, the at least two buffer sleeves comprise a first buffer sleeve located in a rod cavity and a second buffer sleeve located in a rodless cavity, the at least two buffer sleeves are slidable along an axial direction of the piston rod;

the first buffer sleeve is provided with a first sealing end face substantially perpendicular to the axial direction of the piston rod, and the rod cavity end cap is provided with a second sealing end face substantially perpendicular to the axial direction of the piston rod, wherein the first sealing end face has an area greater than that of the second sealing end face;

during an extending movement of the piston, the first sealing end face of the first buffer sleeve is capable of contacting with the second sealing end face of the rod cavity end cap to form a first sealing surface, and hydraulic oil located at a side of the first sealing surface close to the piston is discharged into the oil passage via a first throttle oil channel of the at least two throttle oil channels;

the second buffer sleeve is provided with a third sealing end face substantially perpendicular to the axial direction of the piston rod, and the rodless cavity end cap is provided with a fourth sealing end face substantially perpendicular to the axial direction of the piston rod, wherein the third sealing end face has an area greater than that of the fourth sealing end face;

during a retracting movement of the piston, the third sealing end face of the second buffer sleeve is capable of contacting with the fourth sealing end face of the rodless cavity end cap to form a second sealing surface, and hydraulic oil located at a side of the second sealing surface close to the piston is discharged into the oil passage via a second throttle oil channel of the at least two throttle oil channels;

wherein one of the at least two throttle oil channels comprises an oil channel arranged on a transition sleeve of the piston rod and extending in the axial direction;

wherein each of the at least two throttle oil channels comprises a first segment of oil channel located at an inlet end, and a second segment of oil channel located at an outlet end, the first segment having varied cross-sectional areas, and the second segment having a cross-sectional area smaller than a maximum cross-sectional area of the varied cross-sectional areas of the first segment; and wherein one or more circumferential balancing oil grooves are provided on a surface of the transition sleeve; and the cross section of the balancing oil grooves is V-shaped, U-shaped, square or in any other shape.

2. The hydraulic cylinder according to claim 1, wherein the at least two throttle oil channels are arranged linearly between the piston rod and the at least two buffer sleeves along the axial direction.

3. The hydraulic cylinder according to claim 1, wherein when the piston rod extends to an end of a stroke, the first buffer sleeve keeps a distance from an end point of its sliding towards the piston; and/or when the piston rod retracts to an end of a stroke, the second buffer sleeve keeps a distance from an end point of its sliding towards the piston.

4. The hydraulic cylinder according to claim 1, wherein when the first sealing end face of the first buffer sleeve comes into contact with the second sealing end face of the rod cavity end cap to form the first sealing surface, an area of the first buffer sleeve subjected to an axial action of hydraulic oil in the rod cavity is larger than an area of the first buffer sleeve subjected to an axial action of hydraulic oil in the oil passage; and/or when the third sealing end face of the second buffer sleeve comes into contact with the fourth sealing end face of the rodless cavity end cap to form the second sealing surface, an area of the second buffer sleeve subjected to an axial action of hydraulic oil in the rodless cavity is larger than an area of the second buffer sleeve subjected to an axial action of hydraulic oil in the oil passage.

5. The hydraulic cylinder according to claim 1, wherein the first sealing end face of the first buffer sleeve comes into contact with the second sealing end face of the rod cavity end cap to form a face seal or a line seal; and/or the third sealing end face of the second buffer sleeve comes into contact with the fourth sealing end face of the rodless cavity end cap to form a face seal or a line seal.

6. The hydraulic cylinder according to claim 1, wherein elastic elements for returning the at least two buffer sleeves are provided inside a cavity of the cylinder barrel.

7. The hydraulic cylinder according to claim 1, wherein the at least two throttle oil channels are formed by a throttle inclined surface linearly arranged in a sliding region between the at least two buffer sleeves and the piston rod along the axial direction.

8. The hydraulic cylinder according to claim 1, wherein the cross-sectional area of the first segment becomes smaller gradually towards the piston.

9. The hydraulic cylinder according to claim 1, wherein the transition sleeve is mounted on the piston rod body.

10. The hydraulic cylinder according to claim 1, wherein a shaft shoulder for limiting the first buffer sleeve is provided on the piston rod.

11. The hydraulic cylinder according to claim 1, wherein a stop shoulder for limiting the second buffer sleeve is provided at a tail end of the piston rod located in the rodless cavity.

12. An excavator, comprising a hydraulic cylinder comprising a rod cavity end cap, a cylinder barrel, a piston rod, a piston, and a rodless cavity end cap, the rod cavity end cap being provided with an oil passage, and the rodless cavity end cap being provided with an oil passage, wherein:

at least two throttle oil channels are further provided, and at least two buffer sleeves are provided on the piston rod, the at least two buffer sleeves comprise a first buffer sleeve located in a rod cavity and a second buffer sleeve located in a rodless cavity, the at least two buffer sleeves are slidable along an axial direction of the piston rod;

the first buffer sleeve is provided with a first sealing end face substantially perpendicular to the axial direction of the piston rod, and the rod cavity end cap is provided with a second sealing end face substantially perpendicular to the axial direction of the piston rod, wherein the first sealing end face has an area greater than that of the second sealing end face;

during an extending movement of the piston, the first sealing end face of the first buffer sleeve is capable of contacting with the second sealing end face of the rod cavity end cap to form a first sealing surface, and hydraulic oil located at a side of the first sealing surface close to the piston is discharged into the oil passage via a first throttle oil channel of the at least two throttle oil channels;

the second buffer sleeve is provided with a third sealing end face substantially perpendicular to the axial direction of the piston rod, and the rodless cavity end cap is provided with a fourth sealing end face substantially perpendicular to the axial direction of the piston rod, wherein the third sealing end face has an area greater than that of the fourth sealing end face;

during a retracting movement of the piston, the third sealing end face of the second buffer sleeve is capable of contacting with the fourth sealing end face of the rodless cavity end cap to form a second sealing surface, and hydraulic oil located at a side of the second sealing surface close to the piston is discharged into the oil passage via a second throttle oil channel of the at least two throttle oil channels;

wherein each of the at least two throttle oil channels comprises: an oil channel arranged on the piston rod and extending in the axial direction;

wherein each of the at least two throttle oil channels comprises a first segment of oil channel located at an inlet end, and a second segment of oil channel located at an outlet end, the first segment having varied cross-sectional areas, and the second segment having a cross-sectional area smaller than a maximum cross-sectional area of the varied cross-sectional areas of the first segment; and wherein one or more circumferential balancing oil grooves are provided on a surface of the piston rod; and the cross section of the balancing oil grooves is V-shaped, U-shaped, square or in any other shape.

* * * * *